US006560416B2

(12) United States Patent
Fischer

(10) Patent No.: US 6,560,416 B2
(45) Date of Patent: May 6, 2003

(54) METHODS AND APPARATUS FOR INDICATING LOW TONER IN A COLOR LASER IMAGING DEVICE

(75) Inventor: Todd A. Fischer, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/766,902

(22) Filed: Jan. 18, 2001

(65) Prior Publication Data

US 2002/0094210 A1 Jul. 18, 2002

(51) Int. Cl.[7] ..... G03G 15/08
(52) U.S. Cl. ..... 399/27; 399/223; 399/227; 399/258
(58) Field of Search ..... 399/13, 27, 28, 399/223, 224, 226–228, 258, 262

(56) References Cited

U.S. PATENT DOCUMENTS 5,162,852 A * 11/1992 Ikeda ..... 399/223 X
5,887,217 A * 3/1999 Mitekura et al. ..... 399/27 X
6,151,471 A * 11/2000 Yahata et al. ..... 399/258

* cited by examiner

*Primary Examiner*—William J. Royer

(57) ABSTRACT

Methods and apparatus for indicating a low toner condition in a printer having a plurality of toner cartridges are provided. A method is provided which includes presenting a cartridge having low toner at a cartridge access way where the cartridge can be removed and replaced. The method can also include providing a carriage which can movably support the plurality of toner cartridges and can automatically move the cartridge having low toner to the cartridge access way when a low toner condition is detected. An apparatus is provided which includes a movable carriage which can move in a substantially linear manner. Other apparatus are provided which include a movable carriage which can move in a substantially rotational manner.

7 Claims, 4 Drawing Sheets

METHODS AND APPARATUS FOR INDICATING LOW TONER IN A COLOR LASER IMAGING DEVICE

FIELD OF THE INVENTION

This invention pertains to color laser imaging methods and apparatus and, in particular, to methods and apparatus for indicating a low toner condition in color laser imaging devices.

BACKGROUND OF THE INVENTION

Color printing by an electrophotographic printer is achieved by first scanning a digitized image onto a photoconductor. Typically, the scanning is performed with diodes which pulse a beam of energy onto the photoconductor. The diodes can be, for example, laser diodes or light emitting diodes (LEDs). The photoconductor typically comprises a movable surface coated with a photoconductive material capable of retaining localized electrical charges. In many cases, the movable surface is in the form of a revolvable cylindrical drum.

The surface of the photoconductor is divided into small units called pixels. The photoconductor is generally configured to continuously revolve such that any given pixel is repeatedly moved past the diodes at a substantially regular cycle and at a substantially constant rate, and along a substantially fixed path relative to the diodes. Each pixel is capable of being charged to a given electrical potential, independent of the electrical charge of each surrounding pixel.

During operation of the printer, substantially all of the pixels are first charged to a base electrical charge as they move past a charging unit during each revolution of the photoconductor. Then, as the pixels move past the diodes, the beam of energy, such as a laser, is either directed at, or not directed at, each of the pixels as dictated by the digital data used to pulse the laser. If the laser is directed at a given pixel, the given pixel can be electrically altered by changing (typically discharging) the base electrical charge to a second electrical charge.

Thus, after passing a laser during operation of the printer, a first portion of the pixels will remain at the base electrical charge because they were not exposed to the laser, while a second portion will have a different charge because of being altered by the laser. The first and second portions of unaltered and altered pixels thus form an image on the photoconductor. One portion of pixels will attract toner, while the other portion will not, depending on various factors such as the electrical potential of the toner. That is, the unaltered pixels will either attract or not attract toner, and vice versa with regard to the altered pixels.

Once the toner has been applied to the photoconductor, the toner is then transferred to a finished product medium, such as a sheet of paper. Although the finished product medium typically comprises paper, it can also comprise other materials such as plastic, as in the case of a transparency. The transfer of toner from the photoconductor to the finished product medium can be direct, or it can be indirect using an intermediate transfer device. That is, in the direct method, the toner is transferred directly from the photoconductor to the finished product medium. In the indirect method, the toner is transferred first to an intermediate transfer device, and then transferred from the intermediate transfer device to the finished product medium. The intermediate transfer device typically comprises a revolvable endless belt. During operation of the printer, the intermediate transfer device typically moves by circulating, or revolving, past the photoconductor.

After the toner is transferred to the finished product medium, it is processed to fix the toner thereto. This last step is normally accomplished by thermally heating the toner to fuse it to the finished product medium, or applying pressure to the toner on the finished product medium. Any residual toner on the photoconductor and/or the intermediate transfer device is then removed by a cleaning station, which can comprise either or both mechanical and electrical means for removing the residual toner.

A variety of methods are known for selectively attracting toner to a photoconductor. Generally, each toner has a known electrical potential affinity. As described above, selected pixels of the photoconductor can be exposed by a laser from a base potential to a given potential associated with the selected toner, and then the toner can be presented to the photoconductor so that the toner is attracted only to the selectively exposed pixels. This latter step is known as developing the photoconductor.

In some processes, after the photoconductor is developed by a first toner, the photoconductor is then recharged to the base potential and subsequently exposed and developed by a second toner. In other processes, the photoconductor is not recharged to the base potential after being exposed and developed by a selected toner. In yet another process, the photoconductor is exposed and developed by a plurality of toners, then recharged, and then exposed and developed by another toner. In certain processes, individual photoconductors are individually developed with a dedicated color, and then the toner is transferred from the various photoconductors to a transfer medium which then transfers the toner to the finished product medium. The selection of the charge-expose-develop process depends on a number of variables, such as the type of toner used and the ultimate quality of the image desired.

Image data for an electrophotographic printer (which will also be known herein as a "printer"), including color laser printers, is digital data which is stored in computer memory. The data is stored in a matrix or "raster" which identifies the location and color of each pixel which comprises an overall image. The raster image data can be obtained by scanning an original analog document and digitizing the image into raster data, or by reading an already digitized image file. The former method is more common to photocopiers, while the latter method is more common to printing computer files using a printer. Accordingly, the invention described below is applicable to either photocopiers or printers.

Recent technology has removed the distinction between photocopiers and printers such that a single printing apparatus can be used either as a copier, a printer for computer files, or a facsimile machine. In any event, the image to be printed onto finished product media is provided to the printer as digital image data. The digital image data is then used to pulse the beam of a laser in the manner described above so that the image can be reproduced by the electrophotographic printing apparatus. Accordingly, the expression "printer" should not be considered as limiting to a device for printing a file from a computer, but should also include any device capable of printing a digitized image in the general manner described herein, regardless of the source of the image.

The image data file is essentially organized into a two dimensional matrix within the raster. The image is digitized into a number of lines. Each line comprises a number of discrete points. Each of the points corresponds to a pixel on the photoconductor. Each point is assigned a value representing data pertaining to its color and potentially other attributes, such as density. The matrix of points makes up the resultant digitally stored image. The digital image is stored in computer readable memory as a raster image. That is, the image is cataloged by line, and each line is cataloged by each point in the line. A computer processor, or digital hardware, reads the raster image data line-by-line, and actuates the laser to selectively expose a given pixel based on the presence or absence of coloration, and the degree of coloration for the pixel.

The method of transferring the digital raster data to the photoconductor via a laser, lasers, or LEDs, is known as the image scanning process, or the scanning process. The scanning process is performed by a scanning portion, or scanning section, of the electrophotographic printer. The process of attracting toner to the photoconductor is known as the developing process. The developing process is accomplished by the developer section of the printer. Image quality is dependent on both of these processes. Image quality is thus dependent on both the scanning section of the printer, which transfers the raster data image to the photoconductor, as well as the developer section of the printer, which manages the transfer of the toner to the photoconductor.

In the case of a typical multi-color laser printer, at least one laser scanner is included and utilized to generate a latent electrostatic image on the photoconductor. Generally, one latent electrostatic image is generated for each color plane to be printed. A "color plane" generally refers to a portion of the output image which comprises only a single color of toner. For example, in a four-color laser printer, the final output image comprises four color planes. This allows for each of four colors to be imaged first onto a photoconductor, then transferred onto an intermediate transfer device, and finally transferred from the intermediate transfer device to the finished product medium.

In general, multi-color printers are configured as four-color printers. The four color planes typically printed, and which are generally considered as necessary to generate a relatively complete palate of colors, are yellow, magenta, cyan and black. That is, the typical color printer is provided with toners in each of these four colors. These colors will be known herein as the "primary colors". Some printers have the capability of printing one color on top of another on the same pixel, so as to generate a fuller palate of finished colors.

In a typical scanning process, a laser is scanned from one edge of the photoconductor to the opposite edge while being selectively pulsed in accordance with the image data file. That is, the laser scans across the photoconductor, following a row of pixels. As the laser scans along the row of pixels, it is selectively pulsed a pixel-by-pixel basis. That is, for each pixel in a row, the laser is either directed at the pixel, or not directed at it. The scan of the laser in this manner causes a line of point which make up the digital image to be transferred from the raster onto the photoconductor. As the photoconductor moves past the laser, the laser advances to the next row of pixels, and the next line of points from the digital image is scanned by the laser onto the photoconductor. The image data is thus scanned onto the photoconductor in a pixel-by-pixel and line-by-line basis until the complete image is transferred to the photoconductor.

The side-to-side scanning action of each laser is traditionally accomplished using a dedicated multi-faceted rotating polygonal mirror at which a stationary laser is aimed. The rotation or the mirror causes the reflected laser beam to be scanned across the photoconductor at a unique relative lineal position from a first edge to a second edge of the photoconductor. As the mirror rotates to an edge of the polygon between facets, the reflected laser reaches the edge of the photoconductor. When the laser is reflected off of the next facet as it rotates into position, the laser is essentially reset to the first edge of the photoconductor to begin scanning a new line onto the advancing photoconductor.

Generally, there are two types of color laser printers. One type is the multi-pass printer and the other type is the in-line printer. The multi-pass type of laser printer, also known as the four-pass, is generally provided with a single photoconductor and a single laser/mirror scanner system. The four-pass type is also generally provided with a movable intermediate transfer device, commonly in the form of an endless belt which circulates, or revolves, past the photoconductor. In operation, each of the four color planes (typically black, yellow, cyan, and magenta) which make up an output image is consecutively developed on the photoconductor and completely deposited on the intermediate transfer device. That is, as a first color plane is developed on the photoconductor, it is deposited in its entirety, as toner, on the intermediate transfer device as the device makes a complete first revolution, past the photoconductor.

The intermediate transfer device then begins a second revolution past the photoconductor during which the second color plane is developed on the photoconductor and deposited in its entirety on the intermediate transfer device in registered alignment with the first color plane. This process is repeated in like manner for the third and fourth color planes until all four color planes have been deposited on the intermediate transfer device so as to build-up the completed image thereon. It is important that each succeeding color plane is deposited exactly "on top of" the previous color plane. That is, each succeeding color plane is superimposed, or deposited in registration with, the previous color plane. After the image has been completed with all four color planes on the intermediate transfer device, the image is then transferred to a sheet of finished product medium.

The toner is generally in the form of a fine powder. Each color of toner is contained in a dedicated compartment to avoid mixing of the different color toners prior to deposition of the toners on the photoconductor. The toner compartments are usually configured as cartridges which are removable from the printer apparatus. The removable nature of the cartridges facilitates resupply of the toner. That is, when the level of toner in a given toner cartridge becomes low, or when the cartridge becomes empty, the cartridge can be removed from the printer and replaced by another like cartridge which contains a supply of the same color toner.

As mentioned above, the in-line type of printer generally has a photoconductor and a laser/mirror scanner system of each color toner. Thus, a typical in-line printer will include four photoconductors and four laser/mirror scanner systems, wherein each of the laser/mirror scanner systems correspond to one each of the photoconductors. The photoconductors are usually situated "in-line" relative to one another, and proximate to the intermediate transfer device. Each of the photoconductor-laser/scanner combinations is dedicated to producing a given color plane. For example, a particular photoconductor-laser/scanner combination can produce only yellow color planes, while another photoconductor-laser/scanner combination can produce only magenta color planes.

Prior art printer apparatus have been equipped with low toner detection systems which can detect and identify a low toner condition. These low toner detection systems have been configured to identify the specific toner cartridge which is empty, or which has a low level of toner. Various methods of detecting a low level of toner in a toner cartridge are known and need not be discussed herein.

In order to communicate the low toner condition to the user or operator, prior art printer apparatus have relied on a graphics display interface. That is, prior art printer apparatus have been equipped with a display screen on which the low toner condition, and the specific toner cartridge needing replacement, is identified in the form of text or graphics. Unfortunately, this type of graphics display interface can add considerable complexity to the printer apparatus. Additionally, other prior art printer apparatus have been produced without a graphics display interface in an effort to reduce the complexity of the printer. However, in these latter types of prior art printers the toner cartridge which has a low toner condition is not identified. Thus, in these latter types of prior art printers, the user must physically check each toner cartridge for a low toner condition. This can result in an unacceptable amount of time spent by the user in identifying the low toner cartridge, and can also result in an incorrect identification which, in turn, results in the wrong cartridge being replaced. It is therefore desirable to find a less complex, yet reasonably reliable means of communicating a low toner condition to the user of a color laser printer.

SUMMARY OF THE INVENTION

The invention includes methods and apparatus for identifying a toner cartridge having a low toner condition in a multi-toner printer apparatus, and for presenting a toner cartridge having a low toner condition in a printer apparatus to the user of the apparatus.

In accordance with one embodiment of the present invention, an apparatus for identifying a toner cartridge having a low toner condition in a printer is disclosed. The apparatus comprises a movable carriage for supporting a plurality of toner cartridges. The carriage can be in the form of a substantially rotary carousel. The apparatus also comprises a cartridge access way through which one of the plurality of toner cartridges can be accessed. The apparatus causes a cartridge having a low toner condition to be accessible at the access way by moving the carriage so that the low toner cartridge is positioned at the access way for removal and replacement. The apparatus can be configured to position the low toner cartridge at the access way only at times when the printer is idle.

In accordance with another embodiment of the present invention, an apparatus for identifying a toner cartridge having a low toner condition in a printer is disclosed, wherein the apparatus comprises a movable carriage for supporting a plurality of toner cartridges. The carriage can be configured to remove in a substantially linear manner as apposed to a rotational manner as in the above embodiment. The apparatus causes a cartridge having a low toner condition to be accessible at the access way by moving the carriage so that the low toner cartridge is positioned at the access way for removal and replacement. As in the above, embodiment, the apparatus can be configured to position the low toner cartridge at the access way only during times when the printer is idle.

In accordance with yet another embodiment of the present invention, an apparatus for identifying a toner cartridge having a low toner condition is disclosed, wherein a plurality of toner cartridges are supported in a substantially fixed manner. The apparatus comprises a plurality of cartridge access ways, wherein each one of the cartridge access ways corresponds to one each of the toner cartridges. The apparatus can also comprise a plurality of doors, wherein each one of the doors is configured to cover one each of the cartridge access ways. Alternatively, or in addition, the apparatus can comprise a plurality of visual signal devices, wherein each one of the signal devices corresponds to one each of the cartridge access ways. A low toner cartridge can be identified by causing one of the doors to open, thus presenting the low toner cartridge to the user. Alternatively, one of the visual signal devices can be caused to generate a visual signal, thus identifying to the user a low toner cartridge. The apparatus can be configured to continue printing output images after the low toner cartridge has been identified.

In accordance with still another embodiment of the present invention, a method of presenting a low toner cartridge to the user of a printer is disclosed. The method includes providing a cartridge access way, detecting a low toner condition in a toner cartridge, and causing the low toner cartridge to become accessible through the cartridge access way. The method can also include the step of positioning the low toner cartridge to the cartridge access way. The low toner cartridge can be positioned at the cartridge access way only at times when the printer is idle.

DETAILED DESCRIPTION OF THE INVENTION

The invention includes methods and apparatus for identifying a toner cartridge having a low toner condition in a printer apparatus having a plurality of toner cartridges, and for presenting a low toner cartridge to a user of the apparatus.

The apparatus of the present invention is described as a "printer" among other terms. By "printer" I mean an imaging device that comprises at least one photoconductor onto which at least one toner from one of the plurality of toner cartridges is deposited to form an image. The image is ultimately deposited onto a finished product medium, such as a sheet of paper, to produce an output image. One example of an imaging device which is within the scope of the present invention is a color laser printer. Another example is a color photocopier. Further examples are possible. However, the invention should not be considered as limited to any specific example, but is understood in include all apparatus, and related methods, for producing an image using toner from a plurality of toner cartridges.

Figure 1:
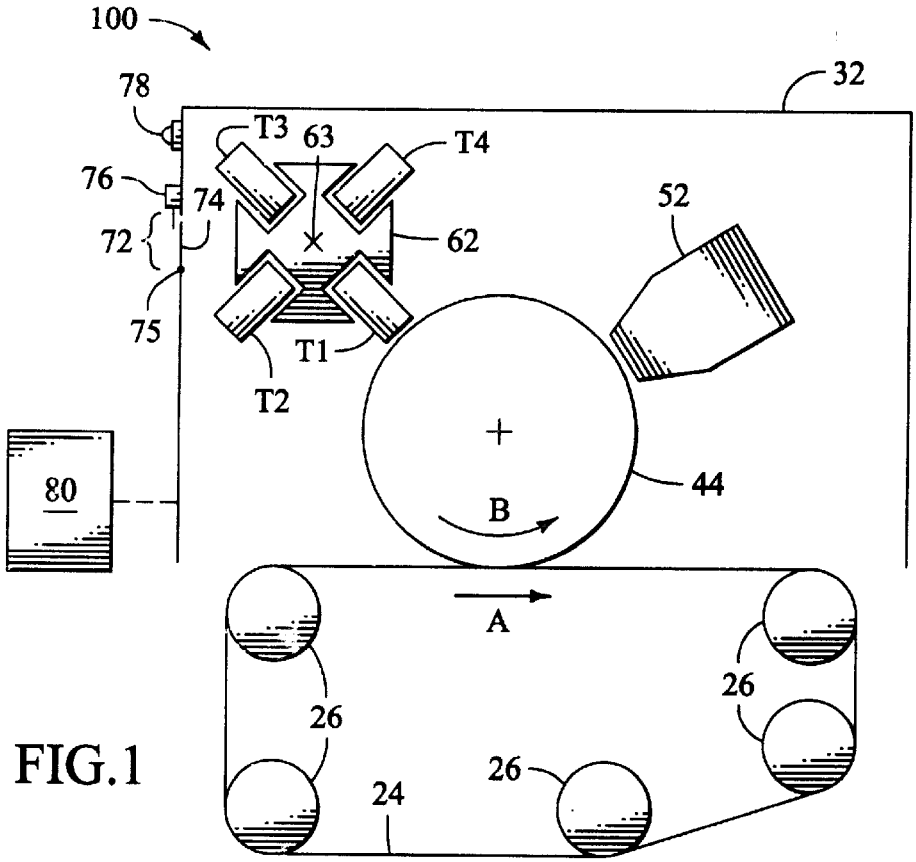
FIG. 1 is a side elevation schematic diagram of an apparatus in accordance with a first embodiment of the present invention.

With reference to FIG. 1, an image-producing apparatus, or printer, 100 in accordance with a first embodiment of the present invention is depicted in a schematic side elevation diagram. As is seen, the apparatus 100 can comprise an intermediate transfer device 24. The intermediate transfer device 24 can be configured as an endless belt supported by a plurality of substantially parallel rollers 26 as shown. The intermediate transfer device 24 can move, or revolve, in the direction "A." The apparatus 100 can also comprise a photoconductor 44 which can be configured to rotate in a direction "B."

The apparatus 100 can also comprise a scanning section 52 which can be configured to scan an image onto the photoconductor 44 as described above. The device 100 comprises a movable carriage 62. The carriage 62 is configured to support a plurality of toner cartridges T1, T2, T3, T4. As is seen the carriage 62 can be configured as a carousel which can be rotated about an axis of rotation 63. Although the axis of rotation 63 is depicted as substantially parallel to that of the photoconductor 44, it is understood that the relative orientation and relative position of the axis of rotation is not limited by the present invention. That is, the purpose of the present invention is not intended to be dependent on the relative orientation or relative position of the axis of rotation 63 of the carriage 62. For example, in an alternative configuration which is not shown, the relative orientation of the axis of rotation 63 can be substantially transverse to its orientation shown. As a further example, the carriage 62 can be oriented and positioned such that the axis of rotation 63 is substantially coaxial relative to the rotation of the photoconductor 44.

The apparatus 100 also comprises a cartridge access way 72. By "cartridge access way," I mean a passage through which a single toner cartridge T1, T2, T3, T4 can be accessed for removal from, and replacement into, its supported position in a printer device. The cartridge access way 72 can be defined in an enclosure 32 or the like. The cartridge access way 72 can be covered by a door 74 which can block the cartridge access way. The door 74 can comprise a transparent material to allow a user to visually detect the presence of a toner cartridge T1, T2, T3, T4 at the cartridge access way 72. A door position sensor 75 can also be included in the apparatus 100 to sense the position of the door 74.

The apparatus 100 can also comprise a lock device 76 which can cause the door 74 to become locked in the closed position as shown so as to prevent the opening thereof. The lock device 76 can incorporate an electric solenoid (not shown) or the like so as to be remotely, and/or automatically, operated. Moreover, the lock device 76 can incorporate a manual override feature (not shown), such as a handle or the like, so that the lock device can be manually operated in the event of a malfunction of the automatic feature. The apparatus 100 can also comprise a signal device 78 which can transmit a signal. The signal device 78 can, for example, comprise a light which can transmit a visual signal. The signal device 78 can, alternatively, comprise a sound-making device which can transmit an audible signal. The apparatus 100 can also comprise a controller 80, such as a processor or the like, to control the function of various components of the apparatus 100.

Figure 1A:
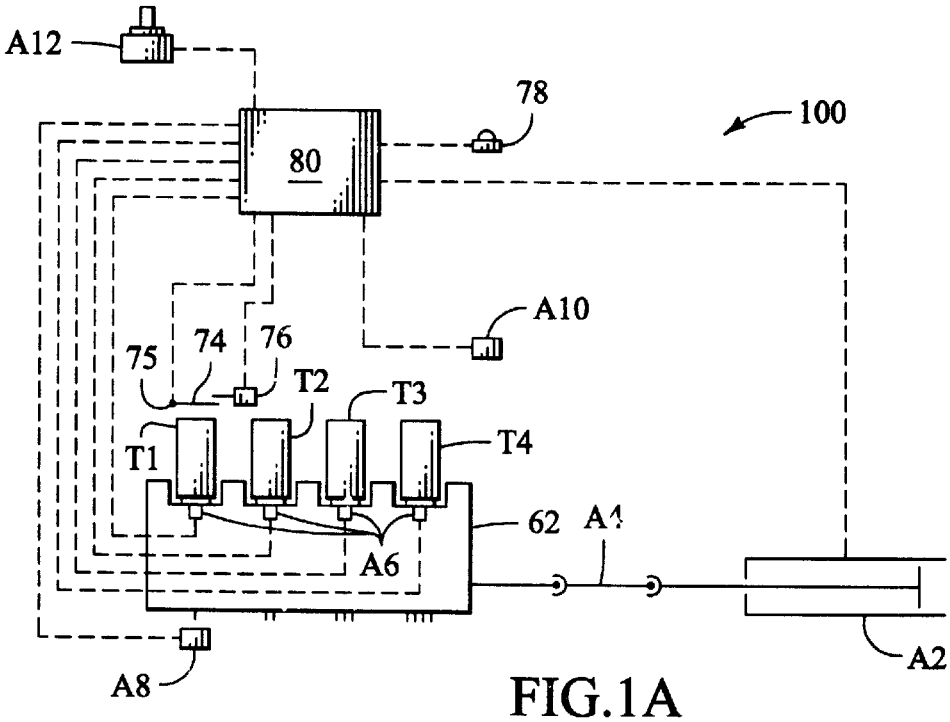
FIG. 1A is a partial schematic control diagram of the apparatus in accordance with the first embodiment of the present invention.

Moving to FIG. 1A, a partial schematic diagram is shown of the apparatus 100. It is understood that the schematic diagram shown in FIG. 1A depicts only one of many possible paths of communication between various components of the apparatus 100. FIG. 1A is not meant to imply any particular means of communication between any of the components, and it is understood that such means can include electrical conductors and fiber optic filaments, as well as wireless means such as electromagnetic energy and sound waves. Furthermore, it is understood that FIG. 1A is meant to be exemplary of any embodiment of the present invention. That is, it is understood that the attributes of the apparatus 100 which are displayed and depicted in FIG. 1A are meant to be applicable to any embodiment of the present invention, including those which are described herein.

As shown in FIG. 1A, the apparatus 100 can comprise a movable carriage 62 which is configured to support a plurality of toner cartridges T1, T2, T3, T4. The carriage 62 can be configured to be caused to move by way of an actuator A2, or the like, such as a motor, which can be connected to the carriage either directly, or indirectly by way of a drive linkage A4 such as a drive belt or the like. A plurality of cartridge sensors A6 can be included in the apparatus 100, and can be configured to detect the presence of at least one of the toner cartridges T1, T2, T3, T4 on the carriage 62. Each of the cartridge sensors A6 can be further configured to detect the presence of a specific toner cartridge associated with a specific color of toner so as to ensure the proper position and presence of each of the different toner cartridges T1, T2, T3, T4. Alternatively, each of the toner cartridges T1, T2, T3, T4 can be uniquely shaped so as to fit only into a correspondingly unique position on the carriage 62.

In the event that a movable carriage is included in the apparatus 100, the apparatus 100 can also include a carriage position sensor A8 which can be configured to detect the relative position of the carriage 62. A low toner sensor A10 can also be included in the apparatus 100, and can be configured to detect a low toner condition in at least one of the toner cartridges T1, T2, T3, T4. It is understood that there are a number of different known means for detecting the low toner condition in the toner cartridges T1, T2, T3, T4, and it is further understood that the specific means so employed in conjunction with the present invention is not material thereto and need not be discussed. The apparatus 100 can further include an operator interface A12, such as a keypad or a switch or the like, which can be configured to input operator commands to the controller 80.

As further depicted, the door 74 which is shown in a closed position, can be configured to cover the cartridge access way 72 (shown in FIG. 1), as described above for FIG. 1. The door position sensor 75 can also be included, and can be configured to detect whether the door 74 is in an open position or closed position. The apparatus 100 can comprise the lock device 76 which is described above, and which can be employed to lock the door 74 in the closed position as shown. The lock device 76 can be actuated, for example, by a solenoid which is activated by the controller 80, as more fully described below. The signal device 78, as described above, can also be included in the apparatus 100, and can be configured to transmit an audible signal or a visual signal.

As shown in FIG. 1A, the apparatus 100 can also comprise a controller 80, such as a processor or the like, which can ba configured to be in communication with the various components included in the apparatus 100 as shown. For example, the controller 80 can be configured to communicate with the actuator A2 so as to control the movement of the carriage 62. Furthermore, the carriage position sensor A8 can be configured to provide feedback to the controller 80 with regard to the relative position of the carriage 62. Similarly, each of the plurality of cartridge sensors A6 can provide feedback to the controller 80 with regard to the presence of a toner cartridge T1, T2, T3, T4 in the carriage 62. Likewise, the door position sensor 75 can be configured to provide feedback to the controller 80 with regard to the position of the door 74.

The controller 80 can also be configured to communicate with the lock device 76 so as to cause the lock device to move to the locked position as shown or to an unlocked position so as to allow the door 74 to open. As further shown, the controller 80 can be in communication with the signal device 78 so as to cause the signal device to transmit a signal as described above. The low toner sensor A10 can be in communication with the controller 80 so as to indicate a low toner condition in one of the toner cartridges T1, T2, T3, T4, and to indicate which toner cartridge has the low toner condition.

The operator interface A12 can also be in communication with the controller 80. The operator interface A12 can be utilized by the operator or user of the apparatus 100 to input operational commands to the controller 80. For example, in the event of a partial operational failure, the operator can override the normal operational sequence of the apparatus 100 by inputting commands to the controller 80 by way of the operator interface A12. The relevance of the discussion for FIG. 1A will become more apparent in the following discussion.

Turning back to FIG. 1, the controller 80 can be configured to prevent movement of the carriage 62 when the door 74 is not in the closed position. Additionally, the controller 80 can cause a temporary suspension of the printing process whenever the door 74 is not in the closed position. Likewise, the controller 80 can be configured to suspend the printing process unless all toner cartridges T1, T2, T3, T4 are present in their respective supported positions within the carriage 62.

Figure 2:
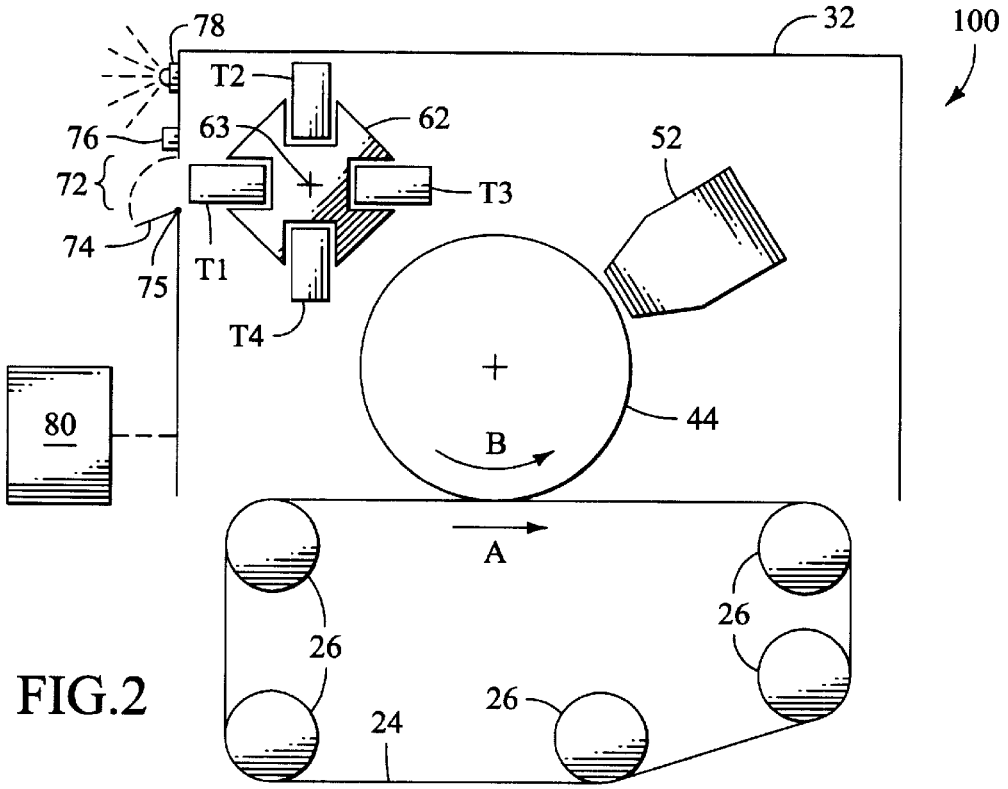
FIG. 2 is another side elevation schematic diagram of the apparatus in accordance with the first embodiment of the present invention, showing a different position of the carriage.

Moving now to FIG. 2, it is seen that the controller 80 can be configured to cause any one of the toner cartridges T1, T2, T3, T4 to be accessible through the cartridge access way 72. This can be accomplished by causing the carriage 62 to rotate by way of the actuator A2 shown and described in FIG. 1A, so as to move any one of the toner cartridges T1, T2, T3, T4 to an "access position" at the cartridge access way 72. By "access position" I mean a position of a given toner cartridge T1, T2, T3, T4 while supported on the carriage, in which position the given toner cartridge can be removed from, and replaced into, its supported position on the carriage 62 through the cartridge access way 72. As depicted in FIG. 2, the first toner cartridge T1 is located in the access position.

Turning back to FIG. 1, during operation of the apparatus 100, the apparatus can produce an output image (not shown) which originates when the scanning section 52 scans a first color plane of an image onto the revolving photoconductor 44. A first toner is then applied to the photoconductor 44 from the first toner cartridge T1 which is located at an "application position." By "application position" I mean a position of a given toner cartridge T1, T2, T3, T4 while supported on the carriage 62, in which position the given toner cartridge can apply toner to the photoconductor 44. The first color plane of the output image (not shown) can be transferred to the intermediate transfer device 24. When the first color plane has been completed by the scanning section 52 and completely developed by the first toner from the first toner cartridge T1, the carriage 62 can then move the second toner cartridge T2 to the application position.

When the second toner cartridge T2 has been moved to the application position, the second toner can then be applied to the photoconductor 44 to the develop the second color plane which is scanned onto the photoconductor 44 by the scanning section 52. It is noted that, in scanning succeeding color planes onto the photoconductor 44, it is important that each of the color planes that make up an image are in registration with one another as discussed above. Once the second color plane is scanned and developed on the photoconductor 44, it can then be transferred from the photoconductor 44 to the intermediate transfer device 24. When the second color plane has been completely developed with the second toner from the second toner cartridge T2, the carriage can move the third toner cartridge T3 to the application position. The processes described above for developing the first and second color planes can then be performed in like manner to develop the third and fourth color planes.

During the production of output images as described above, the door 74 can remain closed and locked. Also, the production of output images can be made to be dependent on the closed position of the door 74. That is, the production of output images can be made to commence only when the controller 80 has detected that the door 74 is closed and locked. It is also evident that, during production of output images, none of the toner cartridges T1, T2, T3, T4 are located at the access position. Thus, if the door 74 comprises a transparent material, such as in the case of a window, none of the toner cartridges T1, T2, T3, T4 are visible through the door 74 during production of output images. It is seen that the access position, wherein a toner cartridge is made accessible at the cartridge access way, is "out of phase" with the application position. When I say "out of phase" I mean that, when one of the toner cartridges T1, T2, T3, T4 is located at the application position, as depicted in FIG. 1, then none of the other toner cartridges are located at the cartridge access way, and vice versa.

Now referring again to FIG. 2, when a toner cartridge T1, T2, T3, T4 having low toner is detected by the apparatus 100 using one of a number of known means, the production of output images can be suspended until the toner cartridge having low toner is removed and replaced. When the toner cartridge T1, T2, T3, T4 having low toner is identified by the apparatus 100, the controller can cause the carriage 62 to move one of the cartridges T1, T2, T3, T4 having low toner to the access position at the cartridge access way 72.

The controller 80 can also cause the door 74 to become unlocked so as to allow it to be opened manually by an operator or user. In this manner, the toner cartridge T1, T2, T3, T4 having low toner can be made accessible through the cartridge access way 72. Also, once a low toner condition has been detected, and a low toner signal sent to the controller 80, then the controller can cause the signal device 78 to transmit a signal which is detectable by a user or operator of the apparatus 100. Upon detecting the signal transmitted by the signal device 78, a user or operator of the apparatus 100 can then open the door 74 and remove and replace the toner cartridge T1, T2, T3, T4 having low toner.

Alternatively, the door 74 can be made biased in the open position by a resilient member (not shown) such as a spring or the like. In that case, the door 74 can be made to open automatically when it is unlocked by the controller 80. As a further alternative, the lock device 76 can be omitted and the door can also be made to be biased in the closed position. In any case, once the toner cartridge having low toner has been removed and replaced by a like toner cartridge having a supply of toner, the user or operator of the apparatus 100 can close the door 74. When the door 74 is closed by the user, the controller 80 can detect that the door has been closed, and can then cause the signal device 78 to stop transmitting the signal. The controller 80 can then also cause the production of output images (not shown) to resume.

Thus, it is evident from the above discussion for FIGS. 1 and 2 that the apparatus 100 can be used advantageously as a relatively simple means of indicating a low toner condition and also for identifying which toner cartridge needs to be replaced, and for subsequently presenting the low toner cartridge to the user or operator for replacement. This reduces the opportunity for the wrong cartridge T1, T2, T3, T4 to be removed, and can also reduce the elapsed time of replacing a cartridge by eliminating the need to manually search for the low toner cartridge.

As an alternative to the operational scheme discussed above, the apparatus 100 can be configured so that when a toner cartridge T1, T2, T3, T4 having low toner is detected by the apparatus 100, the normal production of output images continues until the apparatus becomes idle. When the apparatus 100 becomes idle, the carriage 62 moves the low toner cartridge to the access way where the cartridge is available for removal and replacement. By "idle" I mean an operational status of the apparatus 100 or associated printer wherein no output image data is available for printing. That is, "idle" refers to the operational status of the apparatus 100 or associated printer when no images are being printed or awaiting printing.

Thus, if a low toner cartridge is identified and moved to the access way 72 at the beginning of an idle period, but is not removed and replaced before the end of the idle period, the apparatus 100 can simply continue with normal printing of output images if more output image data is received. This can be accomplished by causing the carousel to move the cartridges T1, T2, T3, T4 in the manner described above for normal output image production. That is, if the carriage 62 has moved a low toner cartridge to the access way 72 after finishing a first printing job and the low toner cartridge has not been removed when, after a period of idle time, output image data of a second printing job is received into the apparatus 100, then the apparatus can resume normal output image production in order to print the second print job. This process can then be repeated indefinitely until the low toner cartridge is removed and replaced.

Although the apparatus 100 is depicted in FIGS. 1 and 2 as having a specific angle of rotation between the application position and the access position, it is understood that the present invention includes an apparatus not shown which has any angle of rotation between the application position and the access position. That is, in accordance with the present invention, the cartridge access way 72 can be located in any position relative to the photoconductor 44 which will allow the apparatus 100 to achieve the purpose for which it is intended.

Figure 3:
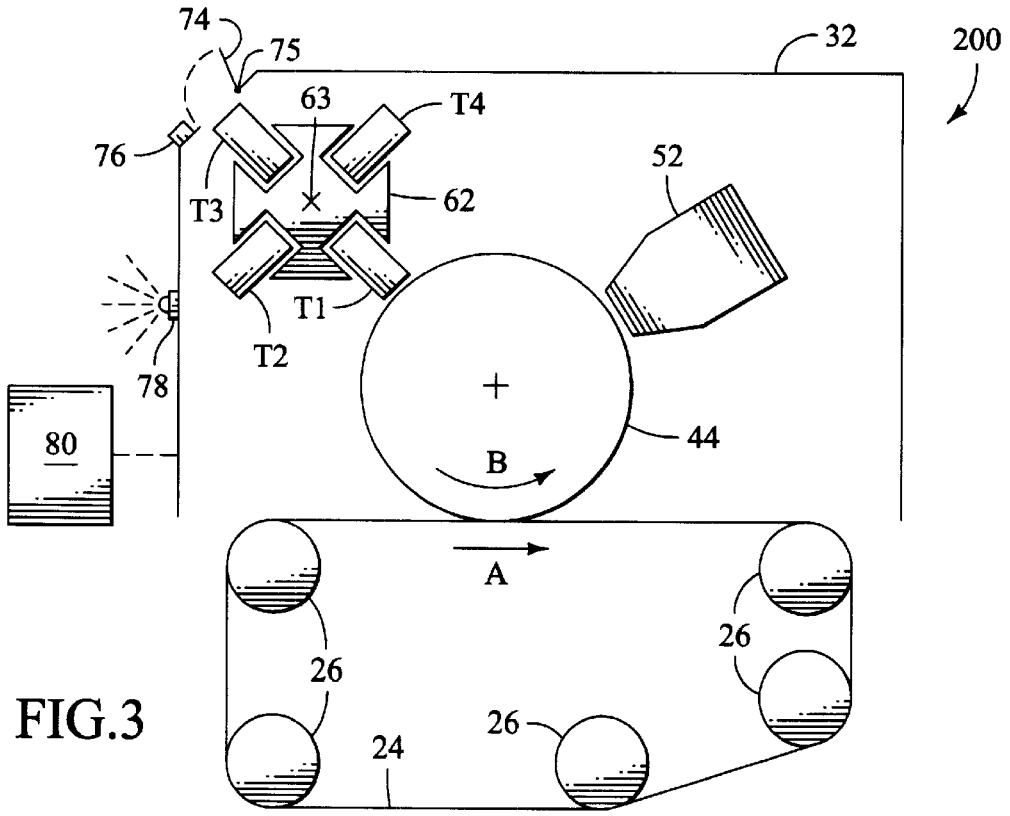
FIG. 3 is a side elevation schematic diagram of an apparatus in accordance with a second embodiment of the present invention.

Referring to FIG. 3, an apparatus 200 in accordance with a second embodiment of the present invention is depicted. FIG. 3 is a schematic side elevation diagram of the apparatus 200. As is seen, the apparatus 200 can comprise the same, or similar, components as does the apparatus 100 described above for FIGS. 1 and 2. That is, the apparatus 200 shown in FIG. 3 can comprise a carriage 62 which is configured to support a plurality of toner cartridges T1, T2, T3, T4, and which is also configured to rotate about an axis or rotation 63. The apparatus 200 can also comprise a processor 80, as well as any of the other components depicted in FIGS. 1, 1A, and 2. Likewise, the apparatus 200 can be configured to operate in a manner similar to that described for the apparatus 100 for FIGS. 1, 1A, and 2 above.

However, as shown in FIG. 3, the apparatus 200 can comprise a cartridge access way 72 that is located relative to the photoconductor 44 so as to be "in phase" with the application position. When I say "in phase" I mean that, when one of the toner cartridges T1, T2, T3, T4 is located at the application position, another of the toner cartridges T1, T2, T3, T4 is located at the cartridge access position, and vice versa. For example, as depicted in FIG. 3, the first toner cartridge T1 is located in the application position wherein a first toner can be applied from the first toner cartridge to the photoconductor 44.

When the first toner cartridge T1 is located in the application position as shown, a third toner cartridge T3 is located in the access position where it can be accessed through the cartridge access way 72. As is evident, the apparatus 200 can comprise a door 74 which can be biased in the closed position by a resilient member (not shown), and can also comprise a door lock 76. The configuration of the apparatus 200 can be advantageous in at least one respect over the configuration of the apparatus 100 described above in that the application position and the access position are in phase. The in phase configuration of the apparatus 200 can eliminate an extra position of the carriage 62. This can both lessen the complexity of the operational sequence and can also shorten the time required to move the low toner cartridge to the access way 72.

Figure 4:
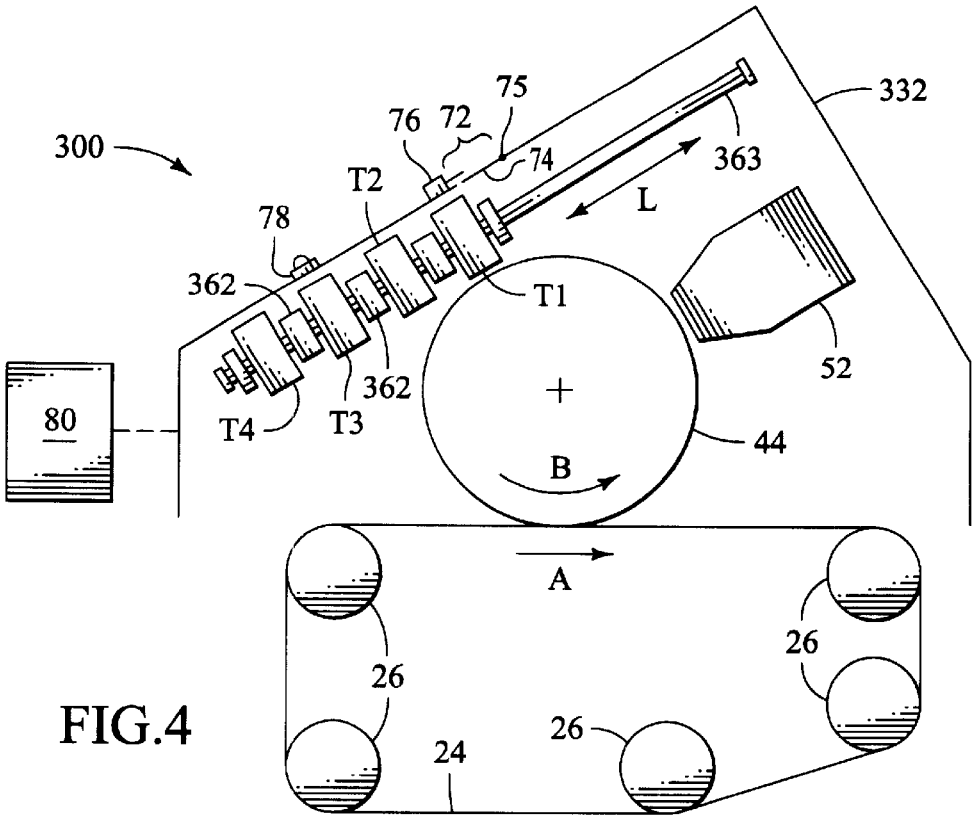
FIG. 4 is a side elevation schematic diagram of an apparatus in accordance with a third embodiment of the present invention.

Now turning to FIG. 4, an apparatus 300 in accordance with a third embodiment of the present invention is depicted in a schematic side elevation diagram. As is seen, the apparatus 300 can be similar to the apparatus 100 and 200 described above for FIGS. 1 through 3. That is, the apparatus 300 can have an intermediate transfer device 24 which can be supported by a plurality of substantially parallel rollers 26 and which can move, or revolve, in the direction "A." The apparatus 300 can also have a photoconductor 44 which moves, or revolves, in the direction "B" and can also have a laser/scanner system 52. The laser/scanner system 52, photoconductor 44 and intermediate transfer device 24 can all function in a manner similar to that described for the apparatus 100 for FIGS. 1, 1A, and 2 above. It is also understood that the apparatus 300 can be configured in the manner described for FIG. 1A.

The apparatus 300 can also have a carriage 362 which can be configured to support a plurality of toner cartridges T1, T2, T3, T4. The carriage 362 can be configured to move substantially linearly in the directions indicated by the arrows marked "L." The carriage 362 can be supported on a guide, or track, 363. The guide 363 can be configured to support the carriage 362. The carriage 362 can be moved in the direction "L" by an actuator (such as the actuator A2 depicted in FIG. 1A) such as a linear motor, a ball-screw device, a rack and pinion device, or the like.

The apparatus 300 can also include an enclosure 332, through which is defined a cartridge access way 72. The cartridge access way 72 can be covered by a movable door 74 which can be biased toward the open position using a resilient member (not shown) such as a spring or the like.

The door 74 can be secured in the closed position as shown by a lock device 76 which can be supported on the enclosure 332. The apparatus 300 can also comprise a signal device 78 as well as a controller 80. The controller 80 can be configured to control various components and operations of the apparatus 300, such as the door 74, lock device 76, signal device 78, carriage 362, and guide 363 as generally described above. For example, the controller 80 can be configured to cause the carriage 362 to move in the directions "L" so as to locate any of the toner cartridges T1, T2, T3, T4 in an application position wherein toner can be applied to the photoconductor 44.

Figure 5:
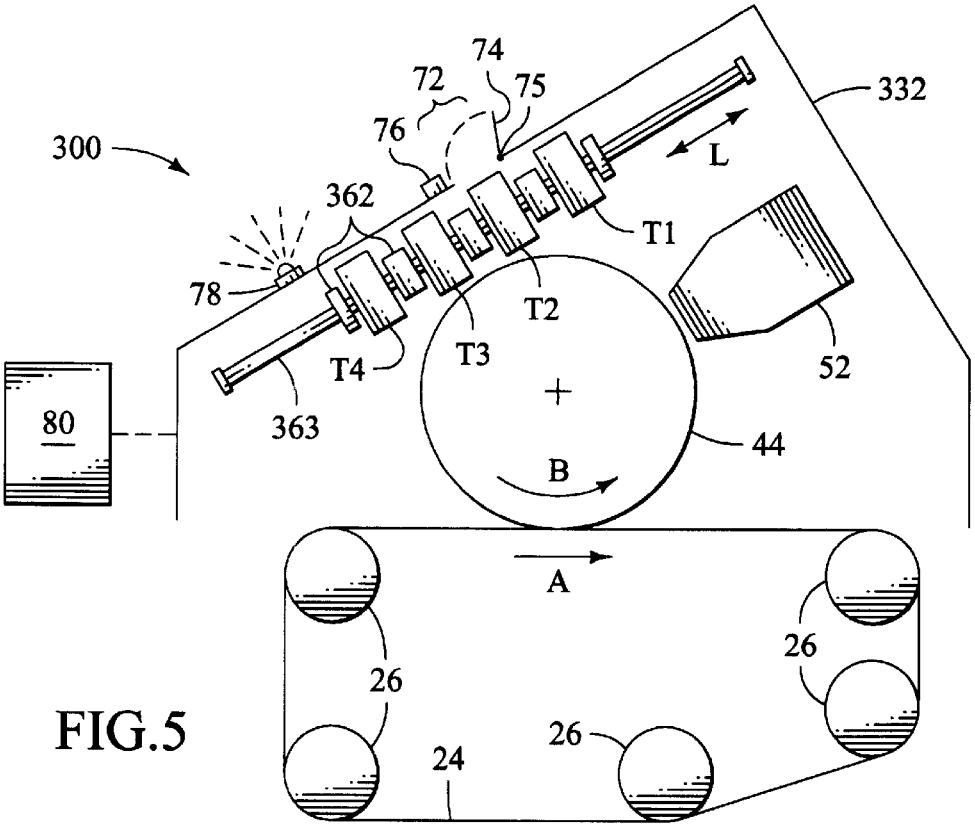
FIG. 5 is another side elevation schematic diagram of the apparatus in accordance with the third embodiment of the present invention, showing a different position of the carriage.

Moving to FIG. 5, another schematic side elevation diagram is shown of the apparatus 300 which is depicted in FIG. 4. As is seen in FIG. 5, the carriage 362 can be configured to move in the directions "L" so as to locate one of the plurality of toner cartridges T1, T2, T3, T4 at the access position at the cartridge access way 72. For example, as shown in FIG. 5, a second toner cartridge T2 is located at the cartridge access way 72. When one of the plurality of toner cartridges T1, T2, T3, T4 is located at the cartridge access way 72, it can be removed from the carriage 362 and replaced by a like cartridge having a supply of toner.

As is evident from a study of both FIGS. 4 and 5, the access position and the application position can be located relative to one another so as to be "out of phase" in a manner similar to that described for the apparatus 100 for FIGS. 1 and 2 above. That is, as is seen in FIGS. 4 and 5, when one of the plurality of toner cartridges T1, T2, T3, T4 is located at the photoconductor 44 in the application position, none of the plurality of toner cartridges is located in the access position at the cartridge access way 72. Conversely, when one of the plurality of toner cartridges T1, T2, T3, T4 is located at the cartridge access way 72 in the access position, none of the plurality of toner cartridges is located at the phctoconductor 44 in the application position. However, it is understood that, in an alternative embodiment (not shown) the apparatus 300 can be configured so that the access position and the application position are substantially in phase as in the case of the apparatus 200 described for FIG. 3 above.

In operation the controller 80, by way of an actuator (such as actuator A2 depicted in FIG. 1A), can cause the carriage 362 to move in the directions "L" so as to locate any of the plurality of toner cartridges T1, T2, T3, T4 at the photoconductor 44 in the application position. In this manner, each of a plurality of color planes can be successively produced on the photoconductor 44 so as to produce an output image. Each of the color planes can be produced by successively depositing each of a plurality of toners onto the photoconductor 44 from each of the plurality of toner cartridges T1, T2, T3, T4 as described above for FIGS. 1, 1A, and 2.

If one of the plurality of toner cartridges T1, T2, T3, T4 is determined to have a low level of toner, the controller 80 can first cause the production of output images to be temporarily suspended until the low toner condition is corrected. The toner cartridge having low toner can be isolated by causing the carriage 362 to move the cartridge to the access position at the cartridge access way 72. The signal device 78 can be caused to transmit a signal which is detectable by a user or operator of the apparatus 300. The lock device 76 can also be caused to unlock the door 74. The door 74 can be opened to provide access to one of the plurality of toner cartridges T1, T2, T3, T4 which has been moved to the access position at the cartridge access way 72. In the case of a door 74 which is biased in the open position by a resilient member (not shown) as described above, the door can be caused to open automatically. Alternatively, the apparatus 300 can be configured to position the low toner cartridge to the access way 72 only when the apparatus 300 is idle as described above for the apparatus 100.

When one of the plurality of toner cartridges T1, T2, T3, T4 having low toner is caused to be accessible through the cartridge access way 72, the cartridge can be removed from the carriage through the access way 72 and can be replaced by a toner cartridge having a supply of toner. A cartridge sensor (such as sensors A6 depicted in FIG. 1A) can be configured to detect that all of the plurality of toner cartridges T1, T2, T3, T4 are present in the carriage 362. Also, the door position sensor 75 can be configured to detect whether the door 74 has been closed. Once the low toner condition has been corrected by the replacement of the toner cartridge T1, T2, T3, T4 having low toner, and the controller 80 has been notified that all cartridges T1, T2, T3, T4 are present, or that the door 74 has been returned to the closed position, the controller can cause the apparatus 300 to resume the production of output images (not shown).

Figure 6:
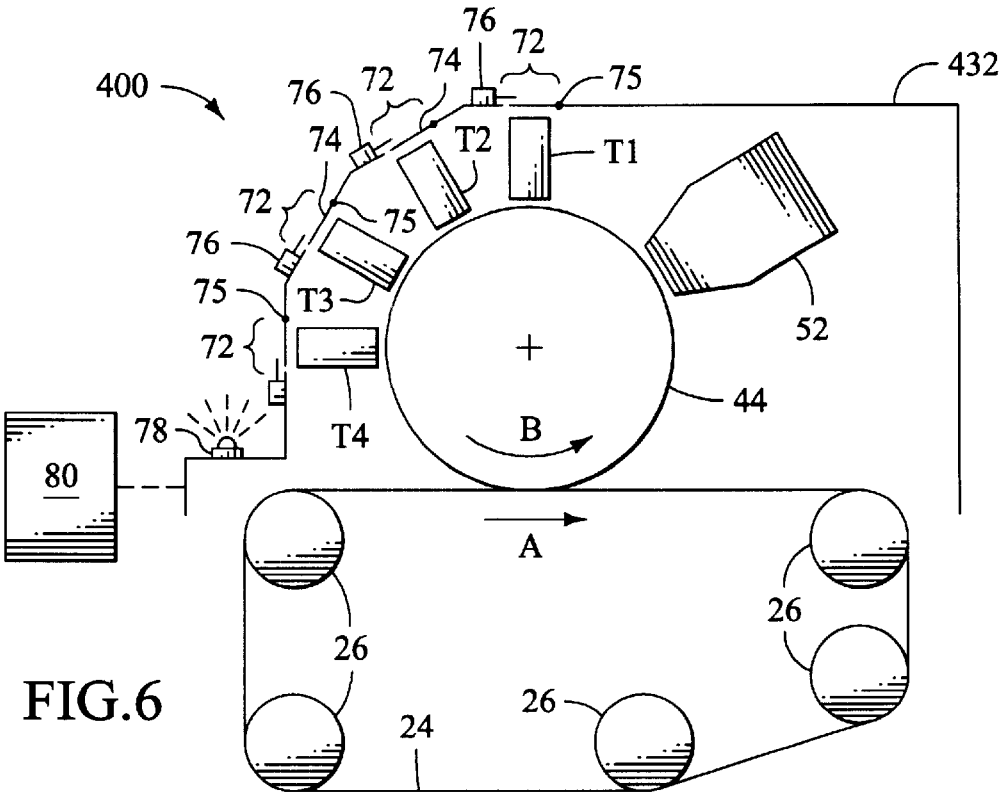
FIG. 6 is a side elevation schematic diagram of an apparatus in accordance with a fourth embodiment of the present invention.

Moving to FIG. 6, a schematic side elevation diagram is shown of an apparatus 400 in accordance with a fourth embodiment of the present invention. As is evident, an apparatus in accordance with the present invention need not comprise a movable carriage, as do the embodiments described above for FIGS. 1 through 5. The apparatus 400 in accordance with the fourth embodiment of the present invention can, however, comprise an intermediate transfer device 24 which can be supported on a plurality of substantially parallel rollers 26. The apparatus 400 can also include a controller 80. It is also understood that the apparatus 400 can be configured, with regard to the controller 80 and related components, in a manner similar to that depicted in FIG. 1A, with the exception of the carriage, carriage position sensor, and actuator.

The apparatus 400 can also comprise at least one photoconductor 44, and at least one laser/scanner section 52. An enclosure 432 can be included in the apparatus 400 as can at least one signal device 78, a plurality of lock devices 76, and a plurality of doors 74. Each of the doors 74 can be configured to selectively cover one each of a plurality of cartridge access ways 72 which can be defined on the apparatus 400 as shown. The apparatus 400 can also comprise a plurality of door position sensors 75 which can be configured to detect the position of each of the doors 74. The controller 80 can be configured to activate the signal device (s) 78 and lock devices 76 as well as to receive signals from the door position sensors 75 regarding the detection of the position of the doors 74.

As is seen in FIG. 6, the apparatus 400 can be configured to support a plurality of toner cartridges T1, T2, T3, T4. Each of the plurality of toner cartridges T1, T2, T3, T4 can be removably supported in a substantially stationary position relative to the cartridge access ways 72. It is evident from FIG. 4 that each of the plurality of toner cartridges T1, T2, T3, T4 can be supported concurrently in both an application position at the photoconductor 44, and in an access position at one of the plurality of cartridge access ways 72. That is, each of the plurality of toner cartridges T1, T2, T3, T4 can be removably supported in a substantially stationary position in which position each of the cartridges can apply a toner to the photoconductor 44, and from which position each of the cartridges can be removed through one of the cartridge access ways 72.

In operation, the apparatus 400 can produce output images (not shown) in a manner similar to that of the embodiments described above for FIGS. 1 through 5. That is, each of a plurality of color planes which make up each output image can be produced in succession on the photoconductor 44. Each of the color planes can be produced by first causing the scanner/laser section 52 to scan each of the color planes onto the photoconductor 44. As each of the color planes is scanned onto the photoconductor 44, one of the plurality of toner cartridges T1, T2, T3, T4 applies toner to the photoconductor 44 before the color plane is transferred to the intermediate transfer device 24.

When a low toner condition is detected in one of the plurality of toner cartridges T1, T2, T3, T4, the controller 80 can be notified of the low toner condition and can cause the signal device 78 to transmit a signal which notifies the user or operator of the low toner condition. This can coincide with a suspension, by the controller 80, of the normal printing operation until the low toner condition is corrected. Alternatively, the controller 80 can be configured to allow normal printing to continue after the low toner condition has been detected and to identify the low toner cartridge when the apparatus 400 is idle. The controller 80 can then identify one of the plurality of toner cartridges T1, T2, T3, T4 as the low toner cartridge by causing the cartridge having low toner to be accessible through one of the cartridge access ways 72. This can be accomplished in one of several manners.

For example, the controller 80 can cause the lock device 76 which is associated with the low toner cartridge to become unlocked. In the case of the doors 74 being biased in the open position by a resilient member such as a spring or the like (not shown), the door associated with the low toner cartridge can be caused to open automatically, thus presenting the user or operator with the low toner cartridge. The user can then remove the low toner cartridge through the cartridge access way 72 associated with the cartridge, and reinstall another like cartridge having a supply of toner.

As shown in FIG. 6, a lock device 76 associated with the second toner cartridge T2 has become unlocked. A door 74 associated with the second toner cartridge T2 is shown to have moved to its open position, presenting the second toner cartridge T2 to be seen by a user of the apparatus 400. The user can thus easily identify the low toner cartridge (in this case T2), and quickly remove and replace the cartridge through the cartridge access way 72 associated with the low toner cartridge.

Figure 7:
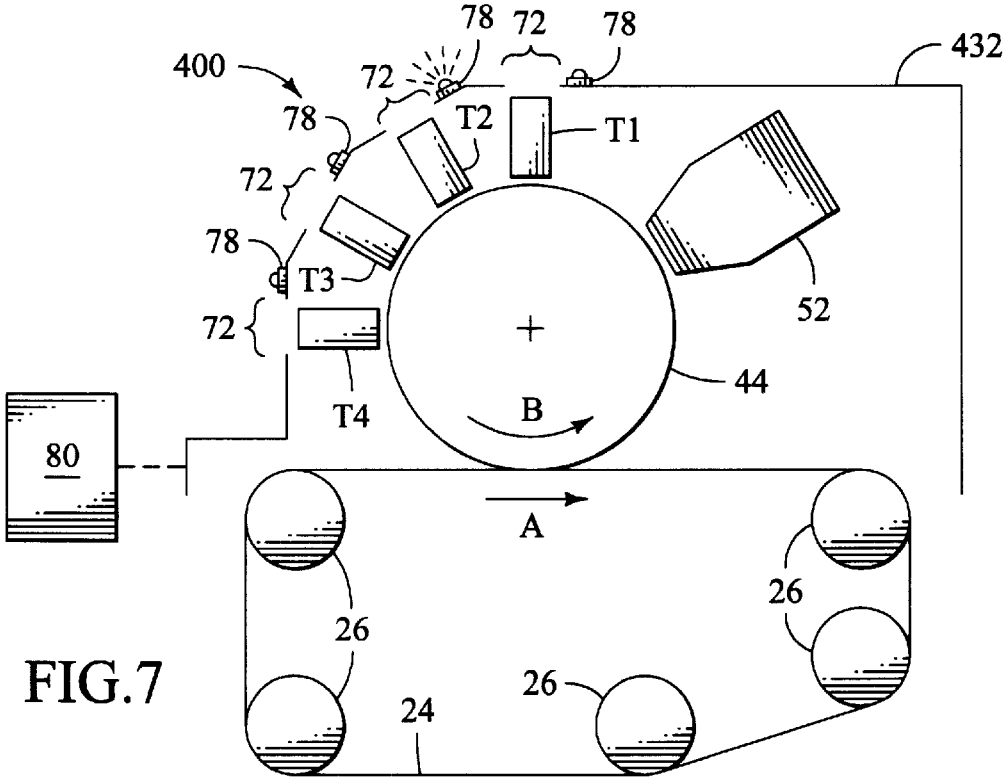
FIG. 7 is a side elevation schematic diagram of an alternative configuration of an apparatus in accordance with the fourth embodiment of the invention which is depicted in FIG. 6.

In an alternative configuration of the apparatus 400 which is shown in FIG. 7, the lock devices 76 can be omitted. A plurality of visual signal devices 78 can be included in the apparatus 400 as shown. That is, each of the toner cartridges T1, T2, T3, T4 can correspond to one each of a plurality of visual signal devices 78. Thus, when one of the plurality of toner cartridges T1, T2, T3, T4 is found to have a low toner condition, the controller 80 can suspend the normal printing operation of the apparatus until the low toner condition is corrected. The controller 80 can also cause the corresponding visual signal device 78 to transmit a visual signal such as a pulsating beam of light or the like which identifies the low toner cartridge.

For example, as shown in FIG. 7, the visual signal device 78 which corresponds to the second toner cartridge T2 has been caused by the controller 80 to transmit a visual signal to indicate a low toner condition in the second toner cartridge. In this manner, the user of the apparatus can easily identify the toner cartridge T1, T2, T3, T4 having a low toner condition. The user can then remove the low toner cartridge T1, T2, T3, T4 and can then remove and replace the cartridge.

Although the apparatus 400 is depicted as comprising only one photoconductor 44, it is understood that in yet alternative configuration of the apparatus 400 which is not shown, the apparatus 400 can comprise a plurality of photoconductors 44, and a plurality of toner cartridges T1, T2, T3, T4, wherein one each of the toner cartridges corresponds to one each of the photoconductors 44, such as in the case of an in-line printer apparatus. In that case, the apparatus 400 can be configured to operate in a manner similar to that of the apparatus 400 as described above for FIGS. 6 and 7.

That is, the apparatus 400 as configured as an in-line printer, can comprise a plurality of cartridge access ways 72, wherein each cartridge access way 72 corresponds to one each of the plurality of toner cartridges T1, T2, T3, T4. When a low toner condition is detected in one of the toner cartridges, the controller 80 can cause the normal printing operation of tne apparatus to be suspended while the low toner condition is corrected. In the case in which the apparatus 400 comprises a plurality of doors 74 as described above for FIG. 6, the controller 80 can cause the door which corresponds to the low toner cartridge to become unlocked as described above for FIG. 6. The door 74 corresponding to the low toner cartridge can be configured to open automatically by way of a resilient member (not shown) which can bias the door in an open position as described above for FIG. 6. Alternatively, the door 74, once unlocked by the controller 80, can be configured to be opened manually by the user.

Alternatively, the apparatus 400 as configured in the manner of an in-line printer can be configured as described for FIG. 7 above. That is, the apparatus 400 can include a plurality of visual signal devices 78, wherein each one of the signal devices corresponds to one each of the toner cartridges T1, T2, T3, T4. In that case, when a low toner condition is detected and the controller 80 is notified of such a condition, the controller can cause the normal printing operation of the apparatus 400 to become suspended until the low toner condition is corrected. The controller 80 can also cause the visual signal device 78 which corresponds to the low toner cartridge to transmit a visual signal which is detectable by the operator or user. The user can then identify the low toner cartridge and replace the low toner cartridge with a cartridge having a supply of toner.

In accordance with a fifth embodiment of the present invention, a method of indicating a low toner condition in a printer having a plurality of toner cartridges is provided. The method comprises providing a cartridge access way and can also comprise providing a plurality of cartridge access ways. The method can include detecting a toner cartridge which has a low toner condition, and can also include the step of causing the cartridge which has a low toner condition to be accessible through the cartridge access way. Causing the cartridge which has a low toner condition to be accessible through the cartridge access way can be an automatic response to the step of detecting a cartridge which has a low toner condition. That is, when a cartridge is found to have low toner, it can then automatically be made accessible through the cartridge access way. The cartridge having low toner can be made accessible through the cartridge access way only when the printer is idle.

As an alternative to being an automatic response to the detection of a low toner condition, the step of causing the low toner cartridge to be accessible through the cartridge access way can be a response to an operator command. That is, the low toner cartridge can be made accessible through the cartridge access way in response to an input command from an operator or user of the printer. This input command can be, for example, the manual opening of a door which covers the cartridge access way, or the pushing of a button. Thus, a further step of the method can be providing a door over the cartridge access way. Another step can be opening the door, wherein the step of causing the cartridge which has a low toner condition to be accessible through the cartridge access way is a response to opening the door.

The method can also comprise providing a movable carriage on the printer, as well as supporting the plurality of toner cartridges on the carriage. The moving of the carriage can be another step in the method, wherein movement of the carriage causes the cartridge which has a low toner condition to become accessible through the cartridge access way. That is, the carriage which supports the plurality of toner cartridges can be moved so that the low toner cartridge is moved along with the carriage to the cartridge access way so as to be accessible there through.

The step of moving the carriage can comprise moving the carriage in a substantially linear manner. For example, the carriage can be supported on a substantially linear track or guide upon which the carriage can be moved. Alternatively, the step of moving the carriage can comprise moving the carriage in a substantially rotational manner. For example, the carriage can be configured as a carousel which is rotatable about an axis of rotation. In this manner, the carriage can be rotated about the axis of rotation so as to move the low toner cartridge to the cartridge access way so as to be accessible there through.

Another step in the method can be providing a lock device which is configured to lock the door over the cartridge access way in a case in which a door is provided. Unlocking the door by activating the lock device can be yet another step of the method. The step of unlocking the door which covers the cartridge access way can be a way of causing the cartridge which has a low toner condition to be accessible through the cartridge access way. For example, if the door is biased in the open position, the step of unlocking the door can result in the door opening automatically, thereby presenting, in the cartridge access way, the cartridge having low toner.

The step of transmitting a signal can be a further step in the method. The transmission of a signal can comprise transmitting a substantially audible signal, and can also comprise transmitting a substantially visual signal. Transmitting a signal can be a way of notifying the user of a low toner condition. For example, a sound-generating device can be used to transmit an audible signal in order to notify the user of a low toner condition in the printer.

Also, the signal can be a way of identifying the particular toner cartridge which has low toner. For example, another step of the method can be providing a visual signal device for each cartridge access way in the case of a plurality of cartridge access ways defined on the printer. In that case, only the particular visual signal device which corresponds to the location of the low toner cartridge can be made to generate a visual signal. In this manner, identifying the low toner cartridge can be accomplished with relative ease.

The transmission of the signal can also be an automatic response to detecting a cartridge which has a low toner condition. For example, when a cartridge having low toner is detected, an audible signal can be transmitted to notify the user of the printer of the low toner condition. Also, the transmission of the signal can be an automatic response to the step of causing the low toner cartridge to be accessible through the access way. For example, when a low toner cartridge is detected, the carriage can be moved so that the low toner cartridge is moved to the cartridge access way. Furthermore, for example, if a door to the cartridge access way and a corresponding lock device are provided, the lock device can be unlocked so that the door can open. In response to opening the door, a signal can be transmitted which can indicate that the cartridge which has a low toner condition is accessible through the cartridge access way.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of indicating a low toner condition in a printer having a plurality of toner cartridges, comprising:

providing a cartridge access way;

detecting a cartridge having low toner;

moving the cartridge having low toner to become accessible through the cartridge access way, thereby indicating the low toner condition, and wherein the cartridge is moved in a substantially linear manner.

2. An apparatus for indicating a low toner condition in a printer, comprising:

a movable carriage configured to support a plurality of toner cartridges thereon;

an enclosure; and, a cartridge access way defined by the enclosure, and through which any of the toner cartridges can be removed from the carriage, wherein the carriage is further configured to move in a substantially linear manner to selectively position a toner cartridge having low toner at the cartridge access way for removal there through from the carriage, and wherein the positioning of the toner cartridge having low toner at the cartridge access way indicates the low toner condition.

3. An apparatus for indicating a low toner condition in a printer, comprising:

a movable carriage configured to support a plurality of toner cartridges thereon;

an enclosure;

a cartridge access way defined by the enclosure, and through which any of the toner cartridges can be removed from the carriage, wherein the carriage is further configured to move to selectively position a toner cartridge having low toner at the cartridge access way for removal there through from the carriage;

a door supported on the enclosure and configured to selectively cover the access way; and, a lock device supported on the enclosure and configured to selectively lock the door in a closed position, and wherein unlocking of the door indicates the low toner condition.

4. An apparatus for indicating a low toner condition in a printer, comprising:

a movable carriage configured to support a plurality of toner cartridges thereon;

an enclosure;

a cartridge access way defined by the enclosure, and through which any of the toner cartridges can be removed from the carriage, wherein the carriage is further configured to move to selectively position a toner cartridge having low toner at the cartridge access way for removal there through from the carriage; and, a door supported on the enclosure and configured to selectively cover the access way, wherein the door is further configured to open automatically when the toner cartridge having low toner is substantially positioned at the cartridge access way, and wherein automatic opening of the door indicates the low toner condition.

5. An apparatus for indicating a low toner condition in a printer, comprising:

an enclosure;

a photoconductor operatively supported within the enclosure;

a plurality of cartridge access ways defined in the enclosure, wherein:

each of a plurality of toner cartridges is operatively supportable within the enclosure by passage through a respective cartridge access way;

each of the plurality of toner cartridges is configured to contain an associated toner selected from a plurality of toners, each of a different color; and, each of the toner cartridges is operable to deposit the respective associated toner onto the photoconductor independently of the other toner cartridges; and, a plurality of doors operatively supported on the enclosure, wherein each of the plurality of doors is associated with a respective cartridge access way and toner cartridge, and wherein a given door is configured to open automatically in response to the associated toner cartridge attaining a low toner condition, and wherein the automatic opening of the given door indicates the low toner condition.

6. An apparatus for indicating a low toner condition in a printer, comprising:

an enclosure;

a photoconductor operatively supported within the enclosure;

a plurality of cartridge access ways defined in the enclosure, wherein:

each of a plurality of toner cartridges is operatively supportable within the enclosure by passage through a respective cartridge access way;

each of the plurality of toner cartridges is configured to contain an associated toner selected from a plurality of toners, each of a different color; and, each of the toner cartridges is operable to deposit the respective associated toner onto the photoconductor independently of the other toner cartridges; and, a plurality of signal devices operatively supported on the enclosure, wherein each of the plurality of signal devices is correspondingly associated with a respective access way and toner cartridge, and wherein each of the signal devices is configured to automatically transmit a substantially visual signal in response to the associated toner cartridge attaining a low toner condition, and wherein the transmitting of the signal indicates the low toner condition.

7. An apparatus for indicating a low toner condition in a printer, comprising:

an enclosure;

a photoconductor operatively supported within the enclosure;

a plurality of cartridge access ways defined in the enclosure, wherein:

each of a plurality of toner cartridges is operatively supportable within the enclosure by passage through a respective cartridge access way;

each of the plurality of toner cartridges is configured to contain an associated toner selected from a plurality of toners, each of a different color; and, each of the toner cartridges is operable to deposit the respective associated toner onto the photoconductor independently of the other toner cartridges;

a plurality of doors operatively supported on the enclosure, wherein each of the plurality of doors is associated with a respective cartridge access way and toner cartridge; and, a plurality of locking devices, wherein each one of the locking devices is associated with a respective door, and is configured to automatically lock and unlock and associated door, and wherein a given locking device is configured to automatically unlock the respective associated door in response to the associated toner cartridge attaining a low toner condition, and wherein the automatic unlocking of the door indicates the low toner condition.

* * * * *